US007673778B2

(12) United States Patent
Sze

(10) Patent No.: US 7,673,778 B2
(45) Date of Patent: Mar. 9, 2010

(54) TABLET CUTTER

(75) Inventor: Ka Chuen Sze, Hong Kong (CN)

(73) Assignee: Apothecary Products, Inc., Burnsville, MN (US)

( * ) Notice: Subject to any disclaimer, the term of this patent is extended or adjusted under 35 U.S.C. 154(b) by 442 days.

(21) Appl. No.: 11/079,435

(22) Filed: Mar. 14, 2005

(65) Prior Publication Data

US 2006/0201985 A1 Sep. 14, 2006

(51) Int. Cl.

| | |
|---|---|
| ***B26F 3/02*** | (2006.01) |
| ***B65H 35/10*** | (2006.01) |
| ***B26H 35/00*** | (2006.01) |
| ***B26D 5/00*** | (2006.01) |
| ***B26D 5/08*** | (2006.01) |
| ***B26B 3/00*** | (2006.01) |
| ***B25F 3/00*** | (2006.01) |

(52) U.S. Cl. ..... 225/104; 83/397; 83/544; 83/605; 225/103; 225/106; 30/124

(58) Field of Classification Search ..... 225/103–105; 83/397, 544, 605–607, 609, 673, 675, 398, 83/497; 30/124; 220/810–813, 345.1, 351, 220/254.3, 254.6, 254.9, 255

See application file for complete search history.

(56) References Cited

U.S. PATENT DOCUMENTS

| | | | | |
|---|---|---|---|---|
| 2,095,330 | A * | 10/1937 | Hedgpeth | 83/102.1 |
| 2,352,235 | A * | 6/1944 | Tautz | 83/102.1 |
| 2,418,958 | A | 4/1947 | Stock | |
| 2,655,259 | A | 10/1953 | Davoren | |
| 3,175,746 | A | 3/1965 | Porter et al. | |
| 3,349,821 | A | 10/1967 | Moeller | |
| 3,439,664 | A | 4/1969 | Sylvester | |
| 3,517,871 | A | 6/1970 | Gaffney et al. | |
| 3,678,884 | A | 7/1972 | Robbins | |
| 3,815,802 | A | 6/1974 | Stevens | |
| 4,009,651 | A | 3/1977 | Adams | |
| 4,179,806 | A | 12/1979 | Lieptz | |

(Continued)

FOREIGN PATENT DOCUMENTS

| | | |
|---|---|---|
| EP | 0 313 934 A2 | 10/1987 |

(Continued)

OTHER PUBLICATIONS

Exhibits A1-A3 Apex Carex Healthcare Products Inc. Pill Cutter; available prior to Mar. 14, 2005; 3 pages.

(Continued)

*Primary Examiner*—Ghassem Alie
*Assistant Examiner*—Bharat C Patel
(74) *Attorney, Agent, or Firm*—Merchant & Gould P.C.

(57) ABSTRACT

The invention is directed to a pill cutter that has a protected cutting edge. The pill cutter includes a guard, a base, and a cover. The components are arranged such that the guard slides over the cutting edge when the pill cutter is in an open position and the guard exposes the cutting edge when the pill cutter is in a closed position. The invention is also directed at a method for assembling the pill cutter and a method of using the pill cutter to cut a pill or tablet.

8 Claims, 2 Drawing Sheets

U.S. PATENT DOCUMENTS

| | | | | | |
|---|---|---|---|---|---|
| 4,422,553 | A | | 12/1983 | Hoeks et al. | |
| 4,825,552 | A | | 5/1989 | Bendickson et al. | |
| 4,879,932 | A | | 11/1989 | Scalise et al. | |
| 4,989,746 | A | * | 2/1991 | Pierce | 220/254.3 |
| 5,020,037 | A | | 5/1991 | Raven | |
| 5,118,021 | A | | 6/1992 | Fiocchi | |
| 5,203,245 | A | * | 4/1993 | Terpstra | 83/397 |
| 5,417,359 | A | | 5/1995 | Zellner | |
| 5,513,548 | A | * | 5/1996 | Garuglieri | 83/397 |
| 5,537,748 | A | * | 7/1996 | Takahashi et al. | 30/124 |
| 5,690,268 | A | * | 11/1997 | Evans et al. | 227/156 |
| 5,944,243 | A | | 8/1999 | Weinstein | |
| 6,419,275 | B1 | | 7/2002 | Huault | |
| 6,449,218 | B1 | | 9/2002 | Lluch | |
| 6,474,525 | B1 | | 11/2002 | Reitano | |
| 6,502,311 | B1 | | 1/2003 | Khachatoorian et al. | |
| 6,527,155 | B2 | | 3/2003 | Buckley et al. | |
| 6,557,945 | B1 | | 5/2003 | Eric | |
| 6,601,746 | B2 | | 8/2003 | Buckley et al. | |
| 7,080,768 | B2 | * | 7/2006 | Marks | 227/120 |
| 7,140,511 | B2 | * | 11/2006 | Baker et al. | 220/813 |
| 7,243,826 | B2 | * | 7/2007 | Darst | 225/103 |
| 2002/0179669 | A1 | * | 12/2002 | Buckley et al. | 225/103 |
| 2003/0019900 | A1 | | 1/2003 | Dienst | |
| 2005/0067452 | A1 | | 3/2005 | Darst | |

FOREIGN PATENT DOCUMENTS

WO WO 2005/030117 A3 4/2005

OTHER PUBLICATIONS

Exhibits B1-B2 Quanterron Inc.Pill Cutter; available prior to Mar. 14, 2005; 2 pages.
Exhibits C1-C4 Links Medical Products' AccuCut Rx™ Personal Tablet Cutter; available prior to Mar. 14, 2005; 4 pages.
Exhibits D1-D4 Pill Cutter; available prior to Mar. 14, 2005; 4 pages.
Exhibits E1-E5 Pill Cutter; available prior to Mar. 14, 2005; 5 pages.
Exhibits F1-F4 NewDay Corporation, Apex Carex Inc. Pill Cutter; available prior to Mar. 14,2005; 4 pages.
Exhibits G1-G5 Pill Cutter; available prior to Mar. 14, 2005; 5 pages.
Exhibit H Health Care Logistics Inc. Blue Tablet Cutter with Window; available prior to Mar. 14, 2005; 1 page.
Exhibit I Apex Medical Corporation Pill Splitter (Blue); available prior to Mar. 14, 2005; 1 page
Exhibit J Apex Medical Corporation Pill Splitter (Orange) ; available prior to Mar. 14, 2005; 1 page.
Exhibits L1-L3 Apothecary Products, Inc. Pill Cutter; available prior to Mar. 14, 2005; 3 pages.
Exhibits M1-M4 Apothecary Products, Inc. Adult Lock® Pocket Pill Cutter; available prior to Mar. 14, 2005; 4 pages.
Exhibits N1-N2 Apothecary Products, Inc. Adult Lock® Pocket Pill Cutter; available prior to Mar. 14, 2005; 2 pages.

* cited by examiner

TABLET CUTTER

FIELD OF INVENTION

The present invention generally relates to cutting devices and more specifically relates to a device for safely and efficiently cutting tablets.

BACKGROUND OF THE INVENTION

Due to numerous practical considerations, pills are not manufactured in dosages small enough to satisfy the needs of all pill consumers. For example, dosages appropriate for small children or adults who are especially sensitive to particular medication are often less than the dosage contained in one tablet or pill (the terms "pill" and "tablet" are used interchangeably throughout this document). In addition, some individuals find it difficult to swallow large pills and would prefer breaking a large pill into smaller parts before consumption.

Primitive methods of breaking pills include snapping pills by hand or cutting pills with an ordinary knife while holding the pill with one's fingers. These primitive methods commonly result in tablet crumbling and/or personal injury. Accordingly, attempts have been made to develop tablet cutters for safely and efficiently cutting tablets. Exemplary tablet cutters are disclosed in the following U.S. patents to Eric (U.S. Pat. No. 6,557,945); Leopoldi et al. (U.S. Pat. No. 4,173,826); Gaffney et al. (U.S. Pat. No. 3,517,871); and Davoren (U.S. Pat. No. 2,655,259). Though today there exist safer and more effective alternatives to using an ordinary knife to split tablets, current tablet cutters can be difficult to manipulate, result in excess tablet crumbling, and include potentially dangerous exposed cutting edges. In addition, known devices can often be difficult to manufacture due to particular design complexities. It would be a significant advance in the art to provide a tablet cutter that embodies fewer of the above-identified shortcomings.

SUMMARY OF THE INVENTION

The invention relates to a pill cutter that has a protected cutting edge. One aspect of the present invention relates to an example pill cutter that includes a blade guard, a base and a cover. The components are arranged such that the blade guard moves to cover the blade when the pill cutter is opened and the blade guard moves to expose the cutting edge when the pill cutter is closed.

Another aspect of the present invention relates to a pill cutter that includes a base, a cover pivotally attached to the base, and a blade guard movably coupled to the cover such that the blade guard moves relative to the cover when the cover is pivoted relative to the base.

A further aspect of the present invention relates to a pill cutter that includes a guide plate that slides over a blade such that when the tablet cutter is biased toward an open position, the guide plate slides toward the blade. When the tablet cutter is biased toward a closed position, the guide plate slides away from the blade.

A yet further aspect of the present invention is directed to a method of assembling a pill cutter. One example method includes fixedly attaching a blade to a cover and slidably attaching a guard to the cover. The guard is configured to slidably move between a first position covering the blade and a second position in which the blade is exposed for cutting.

Another aspect of the invention is direction to a method of cutting a pill. One example method includes positioning a tablet in a base and pivoting a cover toward the base until a blade passes through the tablet.

BRIEF DESCRIPTION OF THE DRAWINGS

The invention may be more completely understood in consideration of the following detailed description of various embodiments of the invention in connection with the accompanying drawings, in which.

While the invention is amenable to various modifications and alternate forms, specifics thereof have been shown by way of example and the drawings, and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION OF THE PREFERRED EMBODIMENT

The present invention generally relates to pill and tablet cutting devices and more specifically relates to pill cutting devices that include a protected cutting edge. The cutting edge may be protected using a movable cover. The movable cover may be configured to move from a first position covering the cutting edge and a second position in which the cutting edge is exposed for cutting. The movable cover may automatically move between the first and second positions when the pill cutting device is adjusted from an open position wherein a pill is positioned relative to the cutting edge for cutting, and a closed position wherein the cutting edge cuts through the pill.

Figure 1:
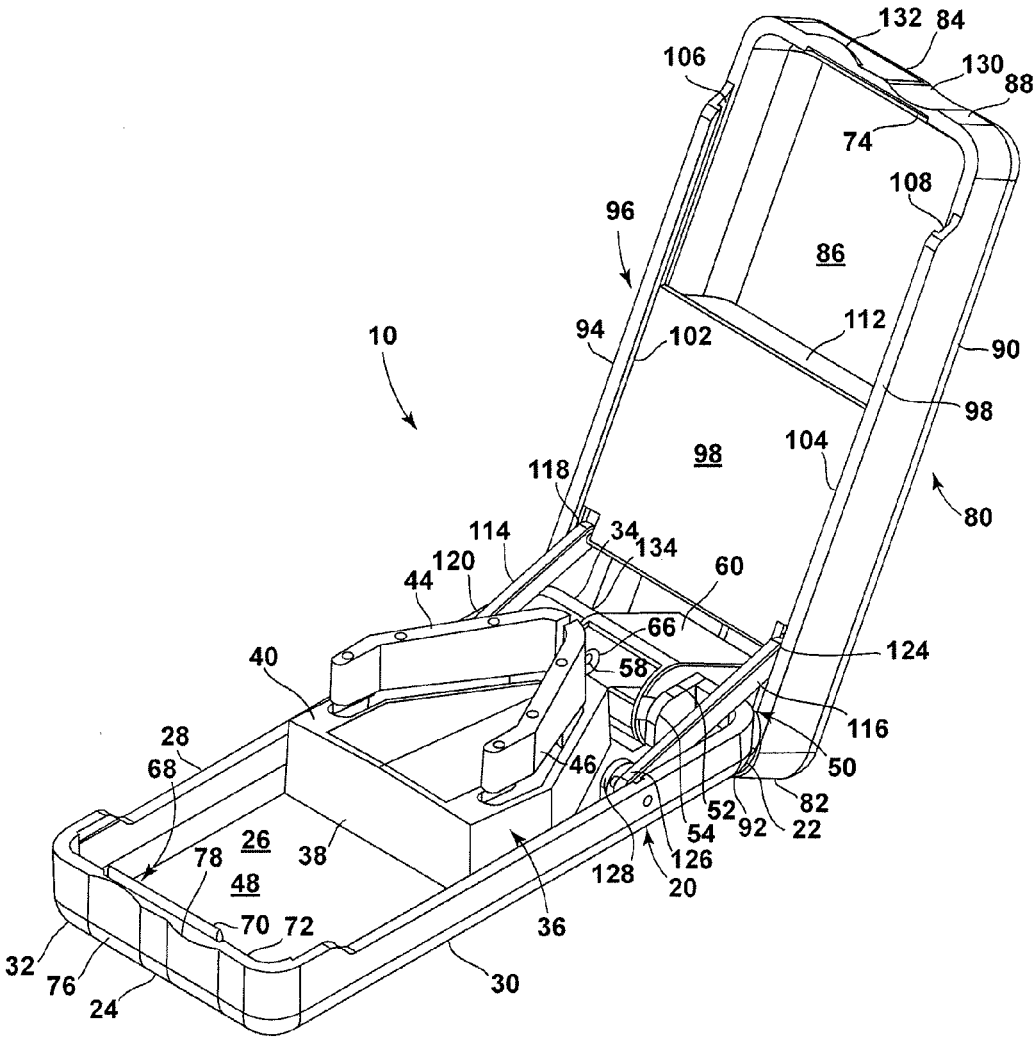
FIG. 1 is a perspective view of a tablet cutter in an open position according to the principles of the invention.
Figure 2:
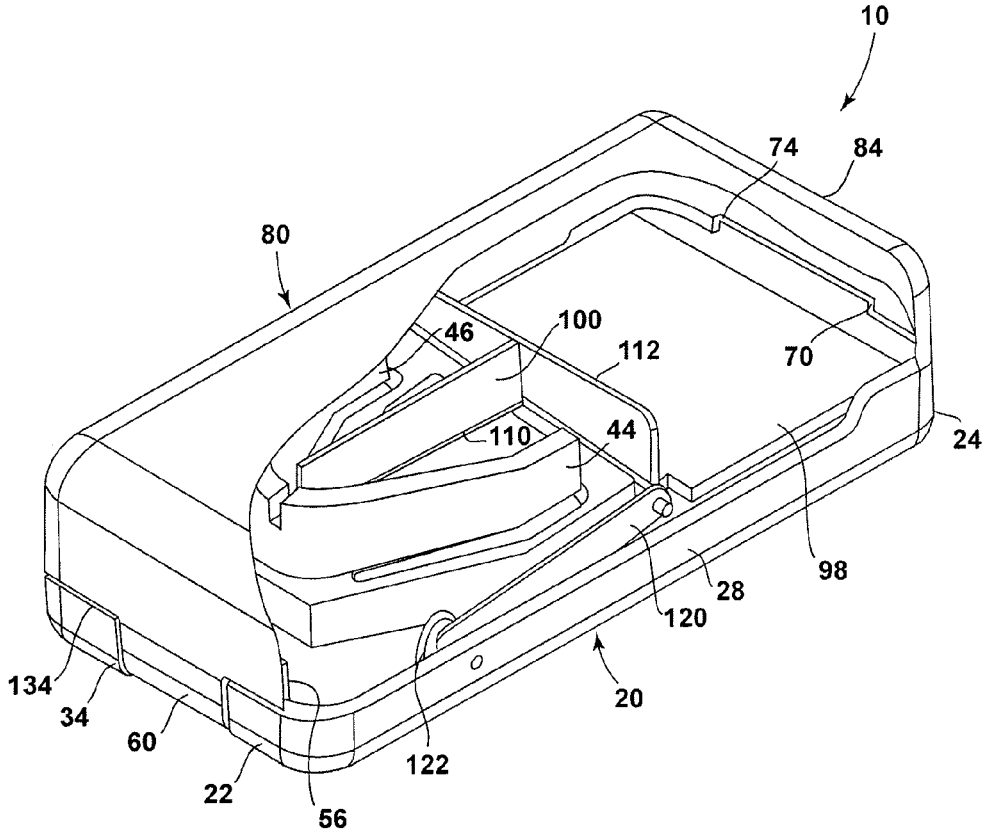
FIG. 2 is a perspective view of a tablet cutter in a closed position with a portion of the cover removed for clarity.

Referring to FIGS. 1 and 2, a tablet cutter 10 according to the principles of the present invention is shown. The tablet cutter 10 includes a base 20 and a cover 80. Cover 80 is shown partially cut away in FIG. 2 to more clearly illustrate features hidden in FIG. 1. The base 20 and the cover 80 are configured to support a tablet in a position for cutting. The cover 80, which houses a blade 100, is coupled to the base 20 such that moving the cover 80 toward the base 20 results in cutting of the tablet.

The base 20 includes a first end 22 and a second end 24 and a generally rectangular bottom portion 26 having four periphery edges. The base 20 further includes four sidewalls 28, 30, 32, and 34 that extend generally perpendicularly from the bottom portion 26 in an upward direction to form a generally open-box shaped structure. Sidewall 34 is disposed at the first end 22 of the base 20 and sidewall 32 is disposed opposite sidewall 34 at the second end 24 of the base 20. Sidewalls 28 and 30 are opposite each other and are oriented along the length of the base 20.

The base 20 further includes a tablet holder assembly 36 for retaining the tablet in a position for cutting. The tablet holder assembly 36 is shown positioned closer to the first end 22 than the second end 24 of the base 20, thereby defining a tablet storage compartment 48 near the second end 24 of the base 20. The tablet holder assembly 36 includes a block 38 that is attached to the bottom portion 26 of the base 20. The block 38 according to the embodiment shown is a raised portion that is integral with the bottom portion 26. The block 38 shown includes a flat top cutting surface 40 a pair of raised centering guides 44, 46 that flank the cutting surface. In the embodiment shown, the centering guides 44, 46 are arranged to form a generally V-shaped structure having a narrow end and an open end. The centering guides 44, 46 are helpful in positioning the tablet before and during cutting. The V-shaped arrangement of the centering guides 44, 46 is particularly useful for positioning many different sizes and shapes of tablets and pills for cutting.

The first end 22 of the base 20 further includes a portion of a hinge assembly 50 that is constructed to couple the base 20 with the cover 80. The hinge assembly 50 includes a notched out back portion 52 having a pair of opposed flanges 54, 56 with base pivots 58 disposed thereon. The base pivots 58 are shown as raised cylindrical bosses that are sized to be received by the cover 80. The cover 80 includes an extender member 60 that projects generally perpendicularly out from a first end 82 of the cover 80. The extender member 60 can be sized to fit the notched out portion 52 of the base 20. The extender member 60 may include apertures 66 that engage the base pivots 58.

The elongate structure of extender member 60 (that is, the length of extender member 60 from the top portion 86 to the flanges 54, 56) provides a lever action when closing the cover 80 relative to base 20. This lever action may improve the amount of force applied between the blade 100 and a tablet positioned on the cutting surface 40.

The second end 24 of the base 20 may further include a portion of a lock assembly 68. The lock assembly 68 includes a lip portion 70 disposed along the inner edge 72 of the sidewall 32. The lip portion 70 is constructed to be interlocked with a lip receiving recess 74 in the cover 80. The lock assembly 68 further includes a first recess portion 76 along the major surface of the sidewall 32 and a first tab 78 on the sidewall 32. The lock assembly 68 includes a matching recess and a matching tab on the cover 80. The sidewall 88 of the cover 80 located at the second end 84 of the cover 80 includes a second recess portion 130 and a second tab 132. The recesses 76, 130 and tabs 78, 132 are arranged such that when the cover 80 and base 30 are mated, the second tab 132 is adjacent the first recess 76 and the first tab 78 is adjacent the second recess portion 130. The tabs 78, 132 may be useful for opening the device 10 when the cover 80 and base 30 are mated, and the recesses 76, 130 provide easier access to the tabs 78, 132.

The cover 80 can include a generally rectangular top portion 86 that has sidewalls 88, 90, 92, and 94 extending from each periphery edge. In the embodiment shown, sidewall 92 is disposed at the first end 82 of the cover 80 and sidewall 88 is disposed at the second end 84 of the cover 80. Sidewall 94 and sidewall 90 are disposed opposite each other along the length of the cover 80.

The cover 80 as shown further includes a blade guard assembly 96 which has a guard plate 98 that slides in relation to the blade 100. The guard plate 98 includes two generally straight periphery edges 102, 104 that are received by sidewalls 90 and 94. In the embodiment shown, sidewall 94 includes a groove 106 that extends along the edge portion of the sidewall 94. The groove 106 is constructed to slidably receive the edge 102. Similarly, sidewall 90 includes a groove 108 that extends along edge portion of the sidewall 94. The groove 108 is constructed to slidably receive the edge 104.

The blade 100 of the blade guard assembly 96 is fixed to the cover 80. The blade 100 is located on the cover 80 closer to the first end 82 than to the second end 84 and approximately equal distance from the sidewalls 90 and 94. The blade 100 is arranged parallel to the sidewalls 90 and 94 and such that its cutting edge 110 extends away from the top portion 86 of the cover 80.

The blade guard assembly 96 may further include an end plate 112 that extends between the sidewalls 90, 94. The blade 100 may be coupled to the end plate 112 to provide additional support for the blade 100. The end plate 112 may also limit exposure of one end of the blade 100 and separate the storage compartment 48 from the cutting surface 40.

The blade 100 may be coupled to the cover 80 using any desired connection method or structure. For example, the blade 100 may be co-molded into the cover 80, coupled to the cover 80 with an adhesive or using heat welding, or coupled to the cover with an interference or snap-fit connection.

The blade guard assembly 96 further includes a first actuator arm 114 and a second actuator arm 116. The first end 118 of the first actuator arm 114 is pivotally connected to the lower end of the guard plate 98 at the corner adjacent the sidewall 94. The second end 120 of the first actuator arm 114 can be pivotally connected to the first fixed pivot mount 122 on the base 20. Likewise, the first end 124 of the second actuator arm 116 is pivotally connected to the lower end of the guard plate 98 at the corner adjacent the sidewall 90. The second end 126 of the second actuator arm 116 can be pivotally connected to the second fixed pivot mount 128 on the base 20. Such an attachment arrangement results in the guard plate 98 sliding toward the second end 84 of the cover 80 when the cover 80 is pivoted toward the base 20 thereby exposing the cutting end 110. Inversely, when the cover 80 is pivoted away from the base 20 the guide plate 98 moves toward the first end 82 of the cover 80 and thereby covers the cutting edge 110.

In some embodiments the base 20 and the cover 80 preferably include a polymer based material. In some embodiments the materials for the base 20, cover 80, and other features of the table cutter 10 may be injection moldable and partially translucent. However, it should be understood that many other materials may be used for various features of the tablet cutter 10. For example, the base 20 and cover 80 can be made of aluminum or glass. Also, the blade 100 may be made of stainless steel, composites, polymer based material such as glass reinforced polymers, ceramics, or other materials.

While the Figures of the application illustrate a tablet cutter having a generally rectangular shape, the present invention is not so limited in shape. Other embodiments may include a generally circular or polygonal shaped base and cover configuration. Likewise, the guard plate may have different shapes beside the rectangular shape shown. Other features of the tablet cutter may also be modified to properly function with different shaped housing members and guard plates. For example, the grooves in which the guard plate slide (e.g., grooves 106, 108 of tablet cutter 10) may be provided in support structures that are separate from the outer walls of the tablet cutter cover. Also, the actuator arms that support the guard plate may be supported by support structures that are separate from the base portion of the tablet cutter.

In yet further embodiments, the guard plate may be removably coupled to the tablet cutter. This type of configuration may be useful for, for example, removing the guard plate in the event the user no longer wishes to have the protective functionality of the guard plate or to repair the blade typically covered when the cover is open relative to the base.

The present invention should not be considered limited to the particular examples or materials described above, but rather should be understood to cover all aspects of the invention as fairly set out in the attached claims. Various modifications, equivalent processes, as well as numerous structures to which the present invention may be applicable will be readily apparent to those of skill in the art to which the present invention is directed upon review of the instant specification.

I claim:

1. A tablet cutter comprising:

a base;

a cover pivotally attached to the base; the cover having a top portion, sidewalls, a first end and an opposite second end;

a blade guard movably coupled to the cover such that the blade guard moves relative to the cover when the cover is pivoted relative to the base; the blade guard having edges slidably received by the cover sidewalls; the blade guard having an upper end nearer to the second end of the cover than the first end of the cover, and a lower end nearer to the first end of the cover than the second end of the cover;

a first actuator rod, the first actuator rod having a first end pivotally attached to the lower end of the blade guard and a second end pivotally attached to the base with a fixed pivot;

a second actuator rod, the second actuator rod having a first end pivotally attached to the lower end of the blade guard and a second end pivotally attached to the base with a fixed pivot;

the blade guard sliding within the cover sidewalls toward the first end of the cover when the cover is pivoted away from the base, and the blade guard sliding within the cover sidewalls toward the second end when the cover is pivoted toward the base.

2. The tablet cutter according to claim 1, further comprising a blade having a cutting edge, the blade being fixed to the cover and arranged such that the cutting edge of the blade extends away from the cover toward the base.

3. The tablet cutter according to claim 2, wherein the blade and the blade guard are arranged such that the blade guard moves in a direction to cover the cutting edge of the blade when the cover is pivoted away from the base, and the blade guard moves in a direction to expose the cutting edge when the cover is pivoted toward the base.

4. The tablet cutter according to claim 1, wherein the sidewalls extend generally perpendicularly from the top portion, the sidewalls defining grooves that receive edges of the blade guard.

5. The tablet cutter according to claim 1, wherein the cover comprises an extender member that extends generally perpendicularly from an end of the cover and the base comprises a notched out sidewall constructed to pivotally receive the extender member located on an end of the base.

6. The tablet cutter according to claim 1, wherein the cover and base are pivotally coupled at a point internal to the base.

7. The tablet cutter according to claim 1, wherein the base includes a container portion sized to store at least one tablet, wherein the container portion is integral with a raised table portion configured to support and position a tablet for cutting.

8. The tablet cutter according to claim 1, wherein the base and cover are injection molded.

* * * * *

UNITED STATES PATENT AND TRADEMARK OFFICE

CERTIFICATE OF CORRECTION

PATENT NO. : 7,673,778 B2
APPLICATION NO. : 11/079435
DATED : March 9, 2010
INVENTOR(S) : Sze It is certified that error appears in the above-identified patent and that said Letters Patent is hereby corrected as shown below:

Title Page Item (56) References Cited, Other Publications: insert --Exhibit K1-K2 Apro Corporation Pill Cutter, U.S. Patent No. 4,422,553; available prior to March 14, 2005; 2 pages.-- in appropriate order Signed and Sealed this Ninth Day of November, 2010

David J. Kappos

David J. Kappos
*Director of the United States Patent and Trademark Office*